US008226140B1

(12) United States Patent
Dietrich et al.

(10) Patent No.: US 8,226,140 B1
(45) Date of Patent: Jul. 24, 2012

(54) ARTICLE HOLDING ASSEMBLY

(75) Inventors: Matt Dietrich, New Bremen, OH (US); Freedus McDermitt, St. Marys, OH (US)

(73) Assignee: Honda Motor Co., Ltd., Tokyo (JP)

( * ) Notice: Subject to any disclaimer, the term of this patent is extended or adjusted under 35 U.S.C. 154(b) by 443 days.

(21) Appl. No.: 12/413,983

(22) Filed: Mar. 30, 2009

(51) Int. Cl.
*B66C 1/42* (2006.01)

(52) U.S. Cl. ..... 294/119.1; 294/81.62; 294/902

(58) Field of Classification Search ..... 294/119.1, 294/81.54, 81.62, 67.33, 67.5, 902; 403/109.2, 403/109.3, 109.8, 92, 96
See application file for complete search history.

(56) References Cited

U.S. PATENT DOCUMENTS

| | | | | | |
|---|---|---|---|---|---|
| 859,513 | A | | 7/1907 | Paige | |
| 1,516,973 | A | | 11/1924 | Laughran | |
| 2,860,002 | A | | 11/1958 | Herbst | |
| 3,168,874 | A | * | 2/1965 | Atanasoff | 104/89 |
| 3,291,329 | A | * | 12/1966 | Ord | 414/420 |
| 3,343,861 | A | | 9/1967 | Sinicki | |
| 4,238,169 | A | * | 12/1980 | DePriester et al. | 414/783 |
| 4,465,314 | A | | 8/1984 | Parson et al. | |
| 4,556,359 | A | * | 12/1985 | Sinclair | 414/621 |
| 4,565,400 | A | * | 1/1986 | Nakashima et al. | 294/197 |
| 4,589,818 | A | | 5/1986 | Brown et al. | |
| 4,591,198 | A | * | 5/1986 | Monforte | 294/207 |
| 4,740,025 | A | * | 4/1988 | Nelson | 294/99.1 |
| 4,765,668 | A | * | 8/1988 | Slocum et al. | 294/207 |
| 4,842,473 | A | * | 6/1989 | Zbornik | 414/626 |
| 4,968,077 | A | * | 11/1990 | Redmon et al. | 294/16 |
| 5,178,431 | A | * | 1/1993 | Voellmer | 294/86.4 |
| 5,403,057 | A | * | 4/1995 | Sugito et al. | 294/119.1 |
| 5,411,306 | A | | 5/1995 | Campbell et al. | |
| 5,429,490 | A | * | 7/1995 | Myers et al. | 425/436 R |
| 5,562,394 | A | | 10/1996 | Brown, Jr. | |
| 5,588,794 | A | | 12/1996 | Panyard | |
| 5,671,960 | A | * | 9/1997 | Chyz | 294/81.3 |
| 5,997,064 | A | * | 12/1999 | Orita | 294/119.1 |
| 6,994,510 | B2 | * | 2/2006 | Cooke | 414/626 |
| 7,332,623 | B2 | * | 2/2008 | Wu et al. | 558/411 |

* cited by examiner

*Primary Examiner* — Dean Kramer
*Assistant Examiner* — Stephen Vu
(74) *Attorney, Agent, or Firm* — Rankin Hill & Clark LLP

(57) ABSTRACT

An article holding assembly for rotatably securing and hoisting various types of articles is provided. The article holding assembly is a clamp type article holding assembly having interchangeable end effectors rotatably secured to bottom ends of clamp arms. The end effectors act to secure the article and to allow the operator to rotate the article once secured and hoisted. For each article that the article holding assembly is to rotatably secure and lift, a specific pair of end effectors is provided. The end effectors are readily secured to and removed from the clamp arms.

4 Claims, 13 Drawing Sheets

ARTICLE HOLDING ASSEMBLY

BACKGROUND

In a machine shop or other assembly or maintenance facility, it is often necessary to lift and move heavy articles, such as automotive engine blocks. As an engine block is too heavy for a human operator to lift on their own, article holding assemblies (holding assemblies) are used. There are several types of holding assemblies used to lift and move engine blocks. However, conventional holding assemblies have problems associated with their use.

Conventional holding assemblies are not capable of securing, lifting, and moving different engine block models having different shapes and sizes. Rather, most conventional holding assemblies are designed to secure a particular engine block model. Thus, as most machine shops work with more than one engine block model, the operator is required to locate and use the holding assembly that is configured to lift and move the engine block model that the operator is trying to move. On the other hand, certain conventional holding assemblies may be configured to secure more than one engine block model. However, these conventional holding assemblies require a great deal of adjustment on the part of the operator to adjust the holding assembly from being configured to hold one engine block model to a different engine block model.

Clamp-type holding assemblies for holding different sizes of engine blocks are difficult to adjust. Specifically, conventional clamp-type holding assemblies have a single preset closed position where clamp arms are separated by a fixed distance. Accordingly, when an operator needs to reconfigure the holding assembly to secure an engine block of a different size, the clamp-type holding assembly needs to be reconfigured to reset the distance between the clamp arms when the holding assembly is in the closed position. This operation is time-consuming and difficult.

Yet another issue with conventional holding assemblies is that the holding assemblies are only capable of securing and picking up the engine block from one set position or orientation, typically an upright orientation of the engine block. Accordingly, if the engine block is resting in any other position, the operator must rotate the engine block to the set orientation for the holding assembly to secure the engine block.

In this vein, if the operator needs to work a surface of the engine block that is not accessible from the secured orientation, the operator must move relative to the engine block so as to work the surface. Alternatively, if the engine block is set onto a work surface by the holding assembly, the operator must set the engine block on the surface upright and then rotate the engine block (possibly again) to work the desired surface. Accordingly, if a surface other than one that is exposed while the engine block is resting upright needs to be worked, extra work is required by the operator. Further, if the engine block needs to be hoisted and is resting in any position other than upright, then extra work is required by the operator to rotate the engine block.

Thus, there exists a need in the art for a holding assembly that is capable of securing, lifting, and moving engine blocks of different shapes and sizes. Further, there is a need for a holding assembly that can eliminate the need for operators to rotate the engine blocks by hand prior to securing the article with the holding assembly. Further still, there is a need for a holding assembly that can allow the operator to rotate the engine block so as to desirably position a surface that is to be worked.

SUMMARY

The present invention provides a clamp-type holding assembly with clamp arms that are movable toward and away from each other using a clamp assembly, with end effectors that are removably and rotatably secured to bottom ends of each of the clamp arms. Each pair of end effectors is adapted to secure a particular article. As such, the holding assembly can be used to secure different articles by securing appropriate end effectors to the clamp arms.

The end effectors have rib patterns defined therein, the rib patterns used to secure the particular article associated with the pair of end effectors by receiving a portion of the particular article in the rib patterns. As each corresponding pair of end effectors is configured to engage a particular article, the rib patterns formed in each end effector are formed so as to be an exact negative of the portion of the particular article that is received in the rib pattern.

The end effectors are rotatably secured to the clamp arms and allow the operator to rotate the article once the article is lifted. Further, the end effectors can be rotated prior to engaging the article so as to correspond to a rotational orientation of the article. A rotation control mechanism allows the rotational position of the article to be fixed in any one of a plurality of rotational positions. The rotation control mechanism includes cooperating ball detents and indents disposed and formed in connecting portions of the end effectors and the clamp arms.

The present invention is also directed to a method for using a holding assembly that is adapted to lift a plurality of articles having different shapes and sizes, specifically different engine block models. The method includes an initial step of determining the type of article to be hoisted. The end effectors that correspond to the article are then secured to the clamp arms of the holding assembly. The holding assembly is then positioned relative to the article and the end effectors are rotated so as to correspond to the rotational orientation of the article. The clamp assembly is then operated to close the clamp arms, engaging the end effectors with the article and thereby securing the article to the holding assembly. Further, the method includes a step of lifting the article with the holding assembly, and rotating the lifted article.

BRIEF DESCRIPTION OF THE DRAWINGS

The features of the present invention will be described with reference to the appended figures. Therein.

DETAILED DESCRIPTION

Figure 1A:
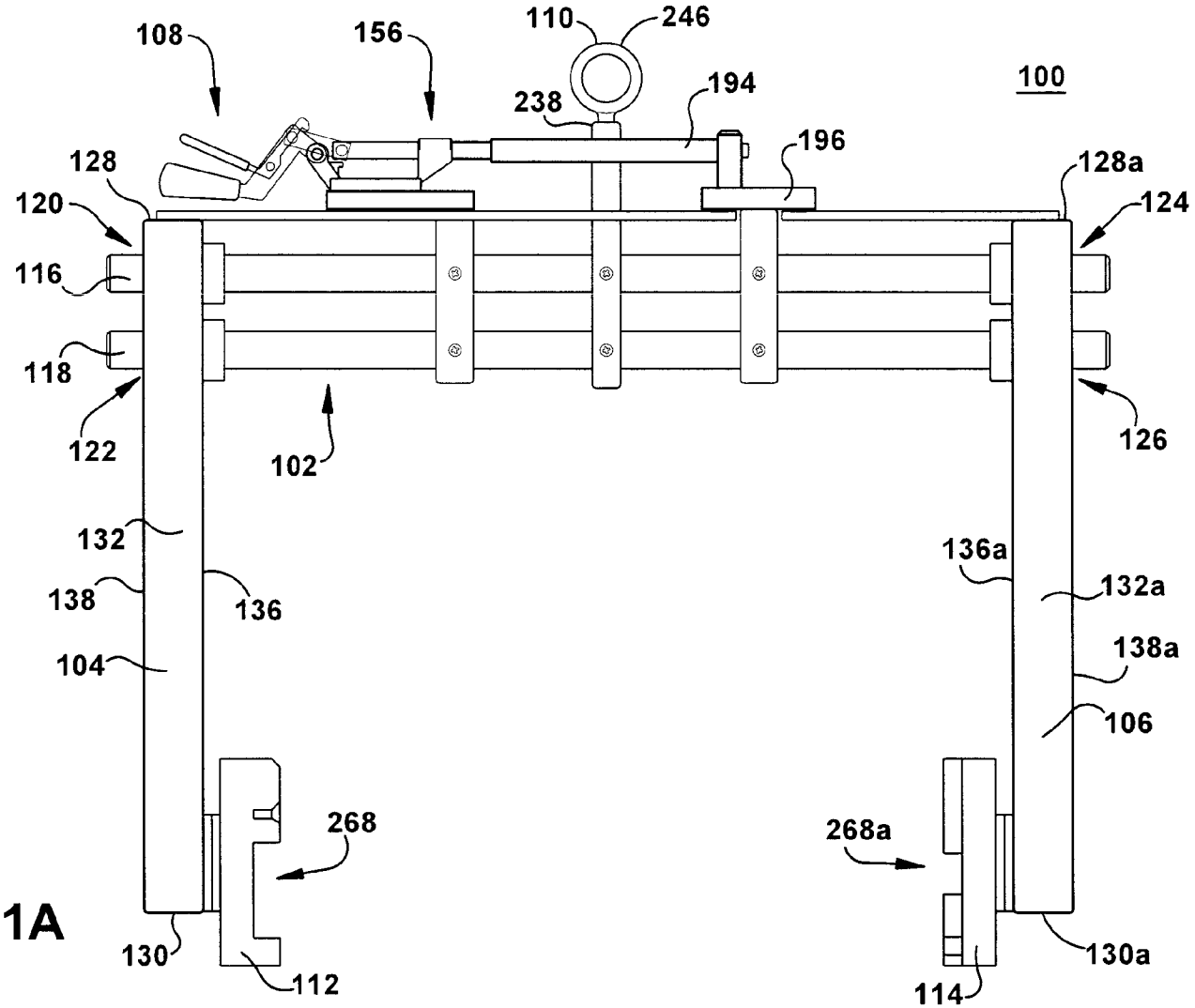
FIG. 1A is a front view of a holding assembly according to the present invention in an opened position.

The present invention will be described hereinafter with reference to the figures. The description is intended to facilitate understanding of the invention and is not intended to limit the scope of the invention to the embodiments illustrated and described herein. In this regard, it is considered that a person of ordinary skill in the art would understand that the present invention is amenable to various modifications and, to the extent practicable, modifications are described. However, the failure to describe any particular modification is not considered to be an admission that the modification falls outside of the scope of the present invention.

With reference to FIGS. 1-9, an article holding assembly 100 (hereinafter, "holding assembly 100") includes a supporting framework 102, a pair of clamp arms 104, 106 that support article engaging end effectors 112, 114, and a clamp assembly 108 for moving the clamp arms 104, 106.

The supporting framework 102 includes an upper rod 116, a lower rod 118, a first clamp support member 162, a second clamp support member 164, and a hanging assembly 110. As is discussed in further detail below, the supporting framework 102 supports the clamp arms 104, 106 and the clamp assembly 108.

The upper rod 116 and the lower rod 118 extend parallel to one another and have a cylindrical shape with flat ends. The rods 116, 118 are preferably formed from a metal, such as aluminum, though a high-strength polymer may be used. The upper rod 116 and the lower rod 118 have identical length dimensions and are disposed such that their flat ends are aligned with one another. As is apparent with reference to the description below, the length of the rods 116, 118 defines a maximum width of the holding assembly 100.

The first and second clamp support members 162, 164 are formed identically to one another. As such, only the first clamp support member 162 will be described, while the components of the second clamp member 164 will have an identical reference numeral with the letter "a" added thereafter.

The first clamp support member 162 is a block like body having a planar rectangular top face 176, an inner face 178, an outer face 180, a wrap face 182, a pair of rod holes 184, a pair of engagement holes 186, and a pair of lock screws 188. The wrap face 182 extends downward from both front and rear edges of the top face 176, and has a curved bottom portion. The pair of rod holes 184 are defined through the first clamp support member 162 in a width direction so as to be formed through the inner face 178 and the outer face 180. The diameter of the rod holes 184 is slightly greater than that of the upper and lower rods 116, 118. The engagement holes 186 are formed through a front surface of the wrap face 182 such that each of the engagement holes 186 connects with one of the pair of rod holes 184. The engagement holes 186 are threaded so as to threadingly receive the threaded lock screws 188.

The hanging assembly 110 is structurally similar to the clamp support members 162, 164 in that the hanging assembly 110 has a body with a planar top surface 238, a pair of rod holes 240, a pair of engagement holes 242, and a pair of lock screws 244. However, the body of the hanging assembly 110 has a greater length in a vertical direction and the also includes an eye bolt 246 extending vertically upward from the top surface 238.

The rod holes 240 are formed through the body of the hanging assembly 110 in a width direction, and are formed so as to have a diameter that is slightly greater than that of the frame rods 116, 118 and identical to that of the clamp support member rod holes 184. The engagement holes 242, which are threaded to threadingly receive the lock screws 244, are formed through a front face of the body of the hanging assembly 110 such that each of the engagement holes 242 connects with an associated rod hole 240.

The eye bolt 246 is rigidly mounted to the hanging assembly top surface 238. The eye bolt 246 has a rod-like member that extends upwardly and an opened circular portion on top of the rod member. The opened circular portion of the eye bolt 246 should be sized so as to receive an industrial hook (as shown in FIG. 3C), and the eye bolt 246 should be secured to the hanging assembly 110 so as to support the weight of the holding assembly 100, as well as the article supported by the holding assembly 100.

Accordingly, the rods 116, 118 extend through the clamp support members 162, 164 and the hanging assembly 110. The clamp support members 162, 164 are positioned on the frame rods 116, 118 such that a distance between a first end of the frame rods 116, 118 and the first clamp support member 162 is equal to a distance from a second end of the frame rods 116, 118 and the second clamp support member 164. The hanging assembly 110 is centered between the first and second clamp support members 162, 164.

Once the clamp support members 162, 164 are positioned on the frame rods, the lock screws 188, 188*a* are rotated in the engagement holes 186, 186*a* until tips of the lock screws 188, 188*a* contact and press against the frame rods 116, 118, thereby locking the clamp support members 162, 164 into position. The clamp support member rod holes 184, 184*a* are sized so as to be slightly larger than the frame rods 116, 118. Accordingly, the clamp support members 162, 164 can be supported on the frame rods 116, 118 with a snug fit between the frame rods 116, 118 and the clamp support member rod holes 184, 184*a*. The clamp support members 162, 164 are thereby mounted on the frame rods 116, 118 so as to be stationary relative to the frame rods 116, 118.

Similarly, once the hanging assembly is set into a position according to a procedure described below, the lock screws 244 are rotated in the engagement holes 242 until tips of the lock screws 244 contact and press against the frame rods 116, 118, thereby locking the hanging assembly 110 into position. As is apparent with reference to the below operational description, the hanging assembly lock screws 244 should be operable to tightly lock the hanging assembly 110 in a set position while being readily loosened so as to allow adjustment of the hanging assembly 110 position.

The supporting framework 102 slidably supports the clamp arms 104, 106. Although the two clamp arms 104, 106 are identical, the clamp arms 104, 106 will hereinafter be referred to as a first clamp arm 104 and a second clamp arm 106, with the first clamp arm 104 supporting a first end effector 112 and the second clamp arm 106 supporting a second end effector 114.

The first clamp arm 104 has a plate-like body that defines an upper rod hole 120, a lower rod hole 122, and an effector hole 140 that receives an effector receiving bushing 142 (hereinafter, "effector bushing 142"). The second clamp arm 106 likewise defines an upper rod hole 124, a lower rod hole 126, and an effector hole 140*a* that receives an effector receiving bushing 142*a* (hereinafter, "effector bushing 142*a*").

The plate-like bodies of the clamp arms 104, 106 are defined by rectangular top and bottom ends 128, 130, 128*a*, 130*a*, front faces 132, 132*a*, rear faces 134, 134*a*, inner faces 136, 136*a*, and outer faces 138, 138*a*, respectively. The rod holes 120, 122, 124, 126, respectively, are formed through the inner faces 136, 136*a* to the outer faces 138, 138*a* of the clamp arms 104, 106, so as to extend across the width of the clamp arms 104, 106 at a position toward a top of the clamp arms 104, 106. The rod holes 120, 122, 124, 126 have a diameter that is slightly greater than that of the frame rods 116, 118 and identical to that of the clamp support members and hanging assembly rod holes 184, 184*a*, 240. Accordingly, the clamp arms 104, 106 snugly fit on the frame rods 116, 118 so as to be slidable along the frame rods 116, 118 while not allowing for excess movement.

Figure 6A:
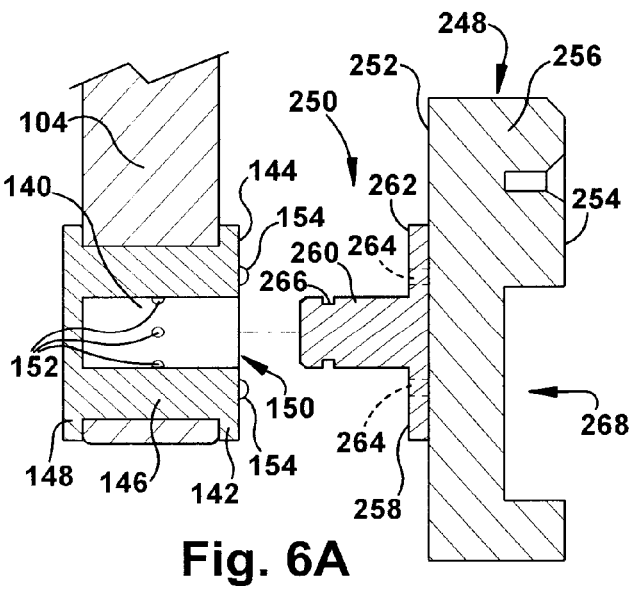
FIG. 6A is an exploded cross-sectional view illustrating the engagement of a clamp arm and an end effector used in the holding assembly according to the present invention.
Figure 6B:
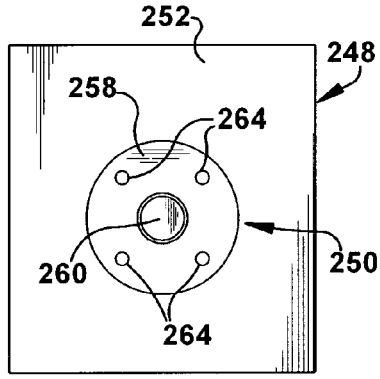
FIG. 6B is a front view an outer surface of the end effector used with the holding assembly according to the present invention.
Figure 6C:
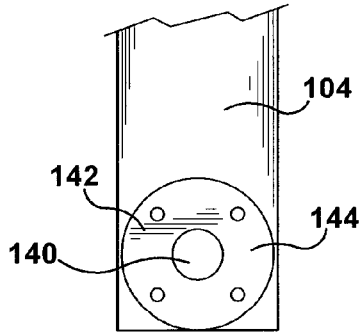
FIG. 6C is a front view of an inner surface of the clamp arm used with the holding assembly according to the present invention.

With reference to FIGS. 6A and 6C, the effector holes 140, 140*a* are defined through the inner face 136, 136*a* and the outer face 138, 138*a* of the clamp arms 104, 106 through the width of the clamp arms 104, 106 at a position toward a bottom of the clamp arms 104, 106. The effector holes 140, 140*a* house the effector bushings 142,142*a*, and are sized so as to receive a connecting portion of the end effectors 112, 114, which will be described in detail below.

The effector holes 140, 140*a* receive the effector bushings 142, 142*a*, which serve as securing mechanisms for rotatably securing the connection portions of the end effectors 112, 114. As the effector bushing 142 of the first clamp arm 104 is identical to that of the second clamp arm 106, only the first effector bushing 142 will be described. The second effector bushing 142*a* is identical to the first effector bushing 142, and is labeled with identical reference numerals with the letter "a" added to the end of the reference numeral to denote that the component is associated with the second effector bushing 142*a*.

The effector bushing 142 has a disc 144, a tubular portion 146, and a stopper 148, wherein the tubular portion 144 interconnects the disc 142 and the stopper 148. The disc 144 is a circular shaped planar member having a diameter greater than that of the effector hole 140. The disc 144 rests flush against the first clamp arm inner face 136 in a region surrounding the effector hole 140, and has a disc effector hole 150 centrally defined therethrough. The disc effector hole 150 has a circular shape and size that corresponds to inner walls of the tubular portion 146.

The tubular portion 146 extends from the disc 144, through the first clamp arm 104, to the stopper 148. The stopper 148 is a circular plate that is affixed to, and extends perpendicularly from, an end of the tubular portion 146. The stopper 148 has a diameter that is greater than that of the effector hole 140. The stopper 148 is spaced from the disc 144 a distance that is equal to the width of the first clamp arm 104 and the length of the tubular portion 146. Accordingly, the effector bushing 142 is securely held in the effector hole 140 of the first clamp arm 104. The stopper 148 and/or the disc 144 may be spot welded to the first clamp arm 104 to affix the bushing 142 thereto. Alternatively, an adhesive or mechanical fastener can be used, thereby preventing rotation of the effector bushing 142 in the effector hole 140.

The effector bushing tubular portion 146 is a hollow, substantially cylindrical member with at least one open end corresponding to a position of the disc effector hole 150. Additionally, the tubular portion 146 includes ball detents 152 extending radially inwardly from the tubular portion 146 at a position that is approximately two-thirds of the length of the tubular portion 146 away from the disc 144. Preferably, the tubular portion 146 has four ball detents 152 that project into the cylindrical opening. As will be discussed in further detail below, the ball detents 152 are positioned so as to releasably engage the end effector 112.

The effector bushing disc 144 has four disc ball detents 154 that project from the disc 144 away from the tubular portion 146 and stopper 148. As will be described in detail below, the cooperation of the disc ball detents 154 and the first end effector 112 provides a mechanism for rotational control of the end effector 112, specifically by providing preset rotational stop positions of the first end effector 112.

The clamp arms 104, 106 are slidably mounted on the frame rods 116, 118 such that the first clamp arm 104 is laterally outside of the first clamp support member 162 and the second clamp arm 106 is laterally outside of the second clamp support member 164. Further, as mentioned above, the clamp arms 104, 106 support the first and second end effectors 112, 114.

The first end effector 112 that is secured to the first clamp arm 104 has the same components as the second end effector 114 that is secured to the second clamp arm 106. Therefore, the description of the components of the end effectors 112, 114 will focus on the first end effector 112. The components of the second end effector 114 will be denoted by the same reference numeral as the corresponding first end effector component, with the addition of a letter "a" thereafter. While describing the components, differences in operational characteristics of the end effectors 112, 114 will be pointed out and discussed.

The first end effector 112 is illustrated in FIGS. 6A, 6B, and 9A-9D, and has a main body 248 and a connection portion 250. The main body 248 is generally block shaped with an outer wall 252 and an inner wall 254 connected by sidewalls 256, where a rib pattern 268 is defined in the end effector 112, as will be described in further detail below. The connection portion 250 includes an effector disc 258 having an outer face 262, an effector rod 260, and four indents 264.

Beginning with the connection portion 250, shown in FIG. 6B, the effector disc 258 is a generally circular shaped planar member that has an inner face secured to the main body outer wall 252. The effector disc 258 has a diameter that is equal to that of the bushing disc 144. The effector rod 260 has a generally cylindrical shape and projects from a center of the effector disc 258. A diameter of the effector rod 260 is substantially equal to the diameter of the effector bushing tubular portion 146.

Further, the effector rod 260 is provided with a groove 266 defined around the cylindrical outside of the effector rod 260 at a position near a distal end of the effector rod 260. The groove 266 is sized and positioned to correspond to the effector bushing tubular portion ball detents 152 when the effector rod 260 is received in the effector bushing 142. The effector disc outer face 262 includes four indents 264 disposed at ninety degree angles with respect to one another around the effector rod 260. The indents 264 are sized and positioned so as to correspond to the four effector bushing disc ball detents 154 when the first end effector 112 is secured to the first clamp arm 104.

Figure 9A:
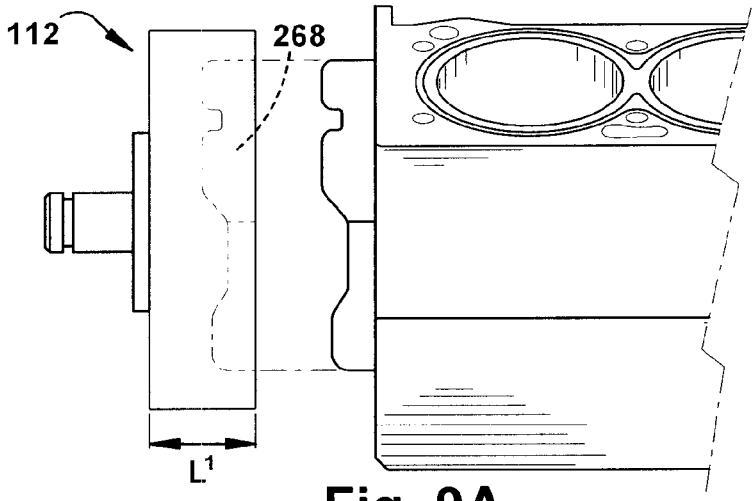
FIG. 9A is a side view illustrating a first rib pattern formed in a first end effector for securing a first engine block according to the present invention.
Figure 9B:
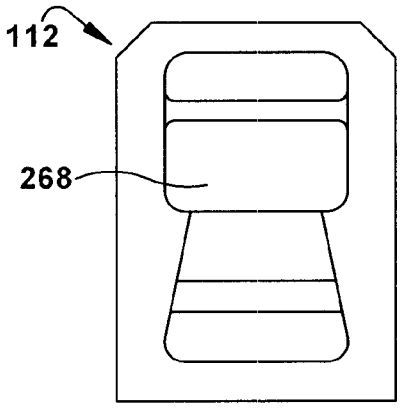
FIG. 9B is a front view of the inner face of the first end effector, illustrating the first rib pattern, according to the present invention.

With reference to FIGS. 9A and 9B, the first end effector 112 has a first rib pattern 268 defined in the main body 248 through the effector inner wall 254. The first rib pattern 268 is defined so as to be a precise negative of a side end surface of the particular article secured by the first end effector 112. The second end effector 114 that forms a corresponding pair with the first end effector 112 is similarly configured to receive an opposite side end surface of the particular article. It is noted that the opposite side end surfaces of the particular article may not be identical to one another. Therefore, the first end effector rib pattern 268 and a second end effector rib pattern 268*a* may be different from one another.

Figure 7:
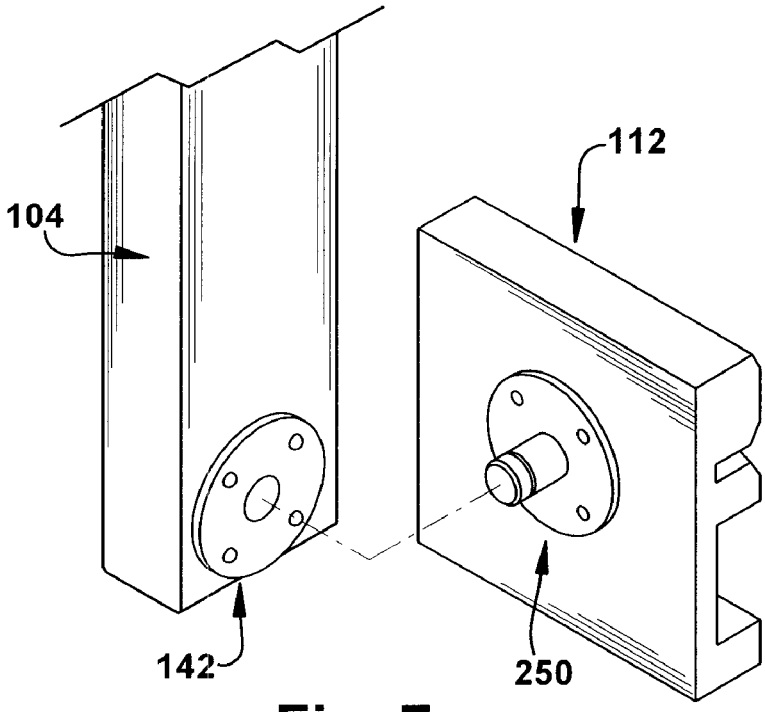
FIG. 7 is a perspective view illustrating the assembly of the end effector with the clamp arm used in the holding assembly according to the present invention.
Figure 8:
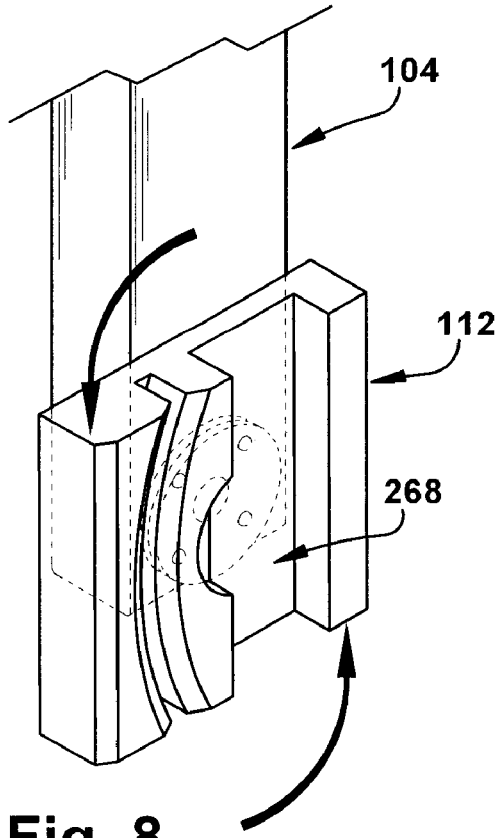
FIG. 8 illustrates the rotatable engagement of the end effector to the clamp arm according to the present invention.

The first end effector 112 is rotatably and releasably secured to the first clamp arm 104 by inserting the effector rod 260 into the effector bushing tubular portion 246, as shown in FIGS. 7 and 8. When the effector rod 260 is inserted into the bushing tubular portion 146, the bushing ball detents 152 are received in the effector rod groove 266 and the end effector 112 is thereby releasably secured to the clamp arm 104. The cylindrical effector rod 260 can rotate within the effector tubular portion 246. As the effector main body 248 is rigidly secured to the effector connection portion 250, the end effector 112 is rotatably secured to the first clamp arm 104. The bushing disc ball detents 154 are releasably received in the effector disc indents 264 in any of the four set rotational positions so as to create four set rotational stop points for the end effector 112 relative to the clamp arm 104. The engagement of the second end effector 114 to the second clamp arm 106 is accomplished in an identical manner.

To facilitate the sliding motion of the clamp arms 104, 106, the clamp assembly 108 is operable to move the clamp arms 104, 106 in a direction either toward or away from one another. The clamp assembly 108 will be described with reference to FIGS. 1A, 1B, 2A, 2B, 3A, 3B, 4, and 5. The clamp assembly 108 according to the exemplary embodiment described herein is a cam-clamp type assembly. A person of ordinary skill in the art can recognize that the cam-clamp type assembly can be substituted for another clamp assembly, and that modifications to the cam-clamp type assembly can be made (as shown in FIG. 12).

The clamp assembly 108 includes a cam-clamp subassembly 156 (hereinafter, "cam-clamp 156") supporting a push rod 194, a first translational plate 158, a second translational plate 160, and a pivot arm 196. The cam-clamp 156 further includes a base plate 190, a cam hinge 192, a lever member 210, a rod support 220, and a trigger member 222.

The cam-clamp base plate 190 is a rectangular planar member that is rigidly secured to the top face 176 of the first clamp support member 162. The base plate 190 supports the cam hinge 192. The cam hinge 192 has a bottom 200, a hinge 202, a push-rod guide 199, a pivot hole 204, and a catch 208. The bottom 200 is a generally planar portion of the cam hinge 192 that is rigidly secured to the base plate 190. The hinge 202 projects diagonally upward and outward from a rear portion of the bottom 200. The hinge 202 is a generally plate-like member that has the circular pivot hole 204 defined through a distal end. The push-rod guide 199 projects upward from a front portion of the bottom 200, and has a circular opening defined therethrough. The circular opening of the push-rod guide 199 has as a diameter that is slightly greater than that of the push-rod 194. The catch 208 projects laterally from the hinge 202 toward the guide 199 at a position adjacent to an elbow formed between the hinge 202 and the bottom 200.

The lever member 210 is a plate-like body that has a lever pin 212, a support leg 214, a main leg 216, a handle 218, a trigger pin 224, and a trigger engagement hole 226. The lever pin 212 is a circular member configured to be received in the pivot hole 204 of the hinge 202. The lever pin 212 orthogonally projects from the lever support leg 214, which is a plate like member that projects perpendicularly from a proximal end of the lever main leg 216.

The lever main leg 216 is longer and wider than the support leg 214 and has the trigger engagement hole 226 defined therethrough and the trigger pin 224 projecting therefrom. The trigger engagement hole 226 is a circular hole defined through the main leg 216 at a position toward a front edge of the main leg 216 just above a center position of the main leg 216. The trigger pin 224 projects from a rear edge of the main leg 216 just below the trigger engagement hole 226.

The handle 218 extends diagonally upward from a distal end of the lever main leg 216. The handle 218 is a plate-like member having a rounded rubber portion at a distal end thereof. The rubber portion is configured so as to be gripped by an operator.

The rod support 220 is a plate member rotatably secured at a front end thereof to the lever member 210 at a corner formed between the support leg 214 and the main leg 216. The rod support 220 extends from the hinge 202 toward the guide portion 199.

The trigger member 222 is a substantially L-shaped member having a grip 228, a hook 230, a lever securing hole 232, a bolt 234, and a biasing mechanism 236. The grip 228 and the hook 230 intersect to provide the trigger member 222 with the L-shape. The grip 228 is generally a rod having a rubberized end that is configured to be easily gripped by an operator. The hook 230 is a plate that extends from the grip 228 and has an outwardly curved portion at a bottom end.

The lever securing hole 232 is defined through the trigger hook 230 in the vicinity of the intersection of the 228 and the hook 230. The securing hole 232 has a diameter that is equal to that of the trigger engagement hole 226 formed in the lever 210. The bolt 234 is configured to pass through the securing hole 232 and the trigger engagement hole 226, and accordingly has a diameter that is slightly smaller than that of the holes 232, 226.

The biasing mechanism 236 is preferably a torsion spring. Accordingly, the biasing mechanism 236 has a central coil with a trigger end and a lever pin end. The biasing mechanism 236 operates to bias the trigger member 222 away from the lever handle 218.

The lever pin 212 is received through the hinge pivot hole 204, thereby rotatably securing the lever member 210 to the cam hinge 192. The trigger member 222 is rotatably secured to the lever member 210 by passing the bolt 234 through the trigger engagement hole 226 and the lever securing hole 232. The bolt 234 is rigidly secured to only the lever member 210. Accordingly, the trigger member 222 is rotatable about the bolt 234 relative to the lever member 210.

Further, the trigger member 210 is biased relative to the lever member 210 by the biasing mechanism 236. The central coil of the biasing mechanism is wrapped around the bolt 234, while the lever pin end is secured to the trigger pin 224 and the trigger end is secured to the trigger member grip 228. Accordingly, the biasing mechanism 236 biases the trigger member 210 relative to the lever member 210 so as to be pressed in rotation in a clockwise direction around the bolt 234. As such, when the lever member 210 is in closed position, as illustrated by the solid lines in FIG. 5, the trigger member hook 230 is pressed into engagement with the cam hinge catch 208. Pulling the trigger member 222 toward the lever member handle 218 releases the trigger member hook 230 from the cam hinge catch 208.

The push rod 194 is a rod member having a diameter that is less than that of the circular opening defined in the cam hinge guide 199. The push rod 194 is rotatably secured to the rod support 220 at a position between the hinge 202 and the guide 199. The push rod 194 passes through the guide 199 and extends away from the cam clamp 156.

The pivot arm 196 is a long member having a first support pin 195 extending downwardly from a first end and a second support pin 197 extending downwardly from a second end. Further, the pivot arm 196 has a centrally disposed rotational mount so as to allow the pivot arm 196 to be mounted so as to rotate about a central point of the pivot arm 196.

The first translational plate 158 is a long plate member having a plate pin 166 projecting downwardly from a position near a distal end of the first translational plate 158 and a securing hole 172 defined through the first translational plate 158 at a position near a proximal end. The second translational plate 160 is a plate member that is shorter than the first translational plate 158, and has a plate pin 170 projecting downwardly from a position near a distal end of the second translational plate 160 and a securing hole 174 defined through the second translational plate 160 at a position near a proximal end.

The push rod 194 is rigidly secured to a top surface of the pivot arm 196 near the first end of the pivot arm 196. The pivot arm 196 is rotatably mounted by the central rotatable mount to the second clamp support member top surface 176*a*. The pivot arm first support pin 195 is rotatably received in the first translational plate securing hole 172, and the pivot arm second support pin 197 is rotatably received in the second translational plate securing hole 174. The first translational plate 158 is secured to the first clamp arm 104 through the rotatable reception of the first translational plate pin 166 in a first clamp arm top surface opening 168. Similarly, the second translational plate 160 is secured to the second clamp arm 106 through the rotatable reception of the second translational plate pin 170 in a second clamp arm top surface opening 168*a*.

In operation, when the lever member 210 is moved to the closed position, the push rod 194 is pressed toward the second clamp arm 106, and thereby presses the first end of the pivot arm 196 toward the second clamp arm 106 and the second end of the pivot arm 196 toward the first clamp arm 104 as a function of the rotatable central mount of the pivot arm 196 to the second clamp support member 164. The first translational plate 158 pulls the first clamp arm 104 toward the second clamp arm 106 while the second translational plate 160 pulls the second clamp arm 106 toward the first clamp arm 104. Conversely, when the lever member 210 is moved to the opened position, the push rod 104 pulls the first end of the pivot arm 196 toward the first clamp arm 104, thereby pushing the second end of the pivot arm 196 toward the second clamp arm 106.

When the lever member 210 is in the closed position, the clamp arms 104, 106 are disposed in as close a proximity to one another as is possible. Conversely, when the lever member 210 is in the opened position, as illustrated by the dotted lines in FIG. 5, the clamp arms 104, 106 are at a maximum distance from one another.

Figure 1B:
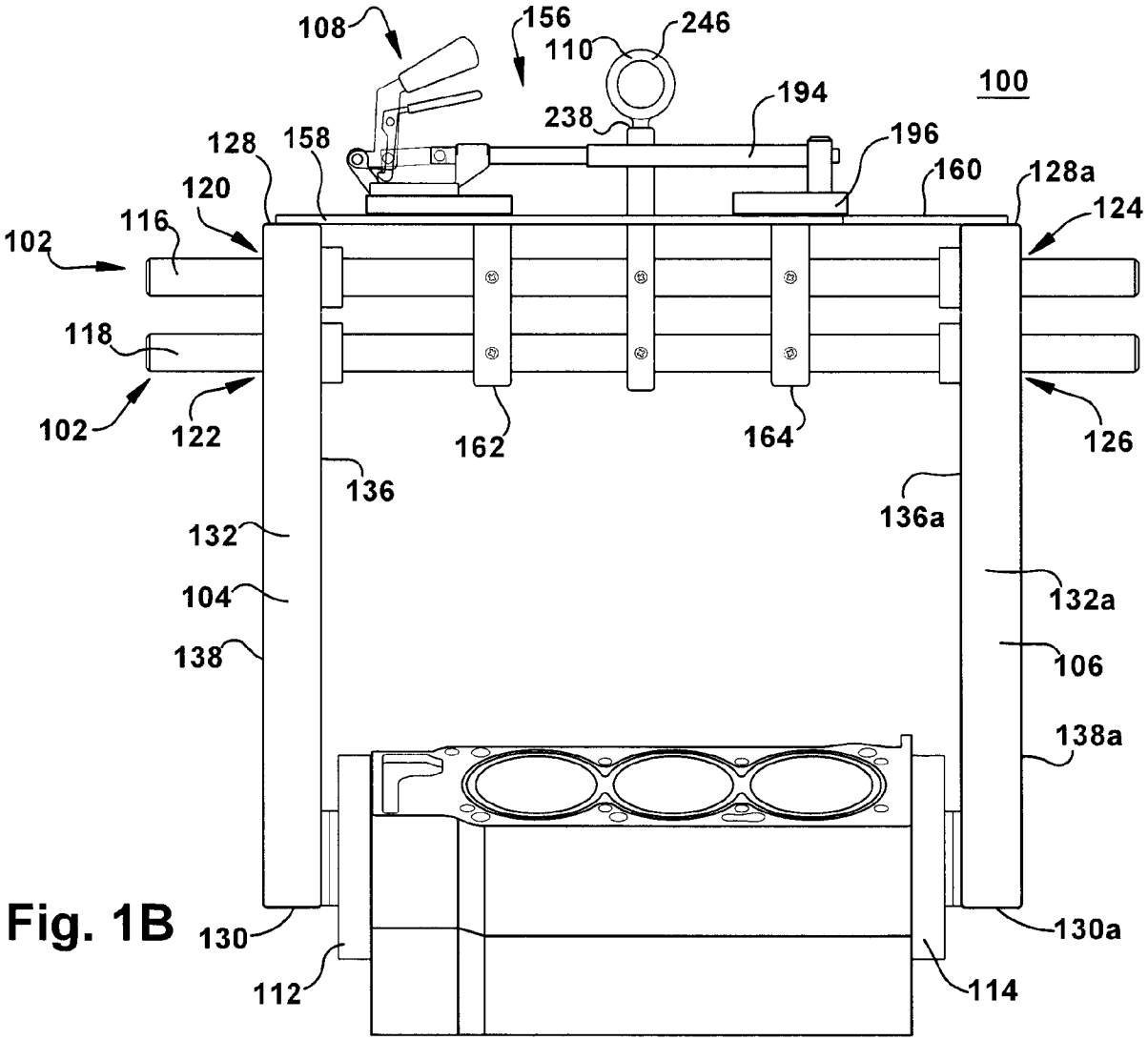
FIG. 1B is a front view of the holding assembly according to the present invention in a closed position.
Figure 2A:
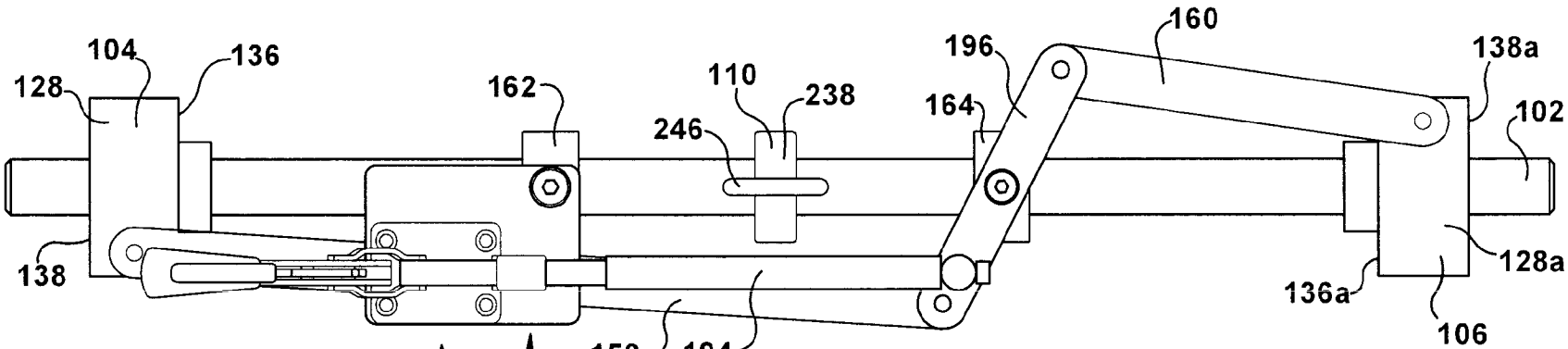
FIG. 2A is a plan view of the holding assembly according to the present invention in the opened position.
Figure 2B:
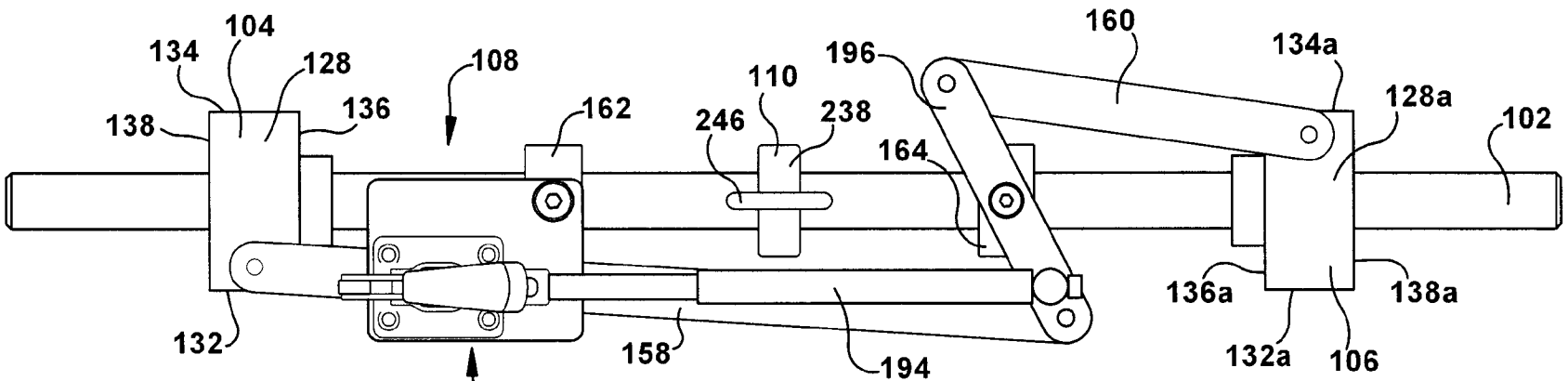
FIG. 2B is a plan view of the holding assembly according to the present invention in the closed position.

Via the above mechanism, the clamp arms 104, 106 are simultaneously pulled toward and pushed away from one another, but remain centered on the framework 102. Accordingly, when in the closed position, the clamp arms 104, 106 cooperate to hold an article, such as an engine block, in a centered position on the holding assembly 100, as shown in FIGS. 1B and 3B.

By holding the article in a centered position, the holding assembly 100 is thereby balanced while holding the article. In this regard, the holding assembly 100 according to the exemplary embodiment is self-balancing. However, if the article is not balanced in the centered position, the hanging assembly 110 may be moved to achieve balance. Specifically, the hanging assembly lock screws 244 are loosened, the hanging assembly 110 is laterally moved along the frame rods 116, 118 to a position that provides a balanced hanging of the article, and the hanging assembly lock screws 244 are tightened to secure the hanging assembly 110 in the balanced position.

Further, the end effectors 112, 114 are easily secured to and removed from the clamp arms 104, 106. Thus, by providing several different pairs of end effectors and configuring each pair to secure a particular article, the holding assembly 100 can be easily reconfigured.

With reference to FIGS. 9A-9D, converting end effectors on the holding assembly 100 as is necessary will be described. Therein, the holding assembly 100 is selectively configured to lift one of two engine block models using an end effector 112 to secure a first engine block model and different end effector 270 to secure a second engine block model.

The end effector 112 for the first engine block has a first rib pattern 268 defined in the main body 248 through the effector inner wall 254, as shown in FIGS. 9A and 9B. The first rib pattern 268 is defined so as to be a negative of a side end surface of the first engine block that is to be received by the first end effector 112. The second end effector 114 has a corresponding rib pattern 268*a* such that the end effectors 112, 114 cooperate to secure the first engine block by receiving side end surface of the engine block in the rib patterns 268, 268*a*.

Figure 9D:
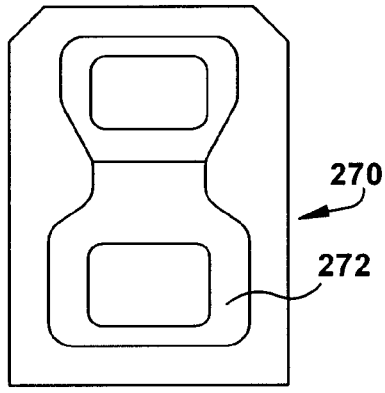
FIG. 9D is a front view of the inner face of the second end effector, illustrating the second rib pattern, according to the present invention.
Figure 9C:
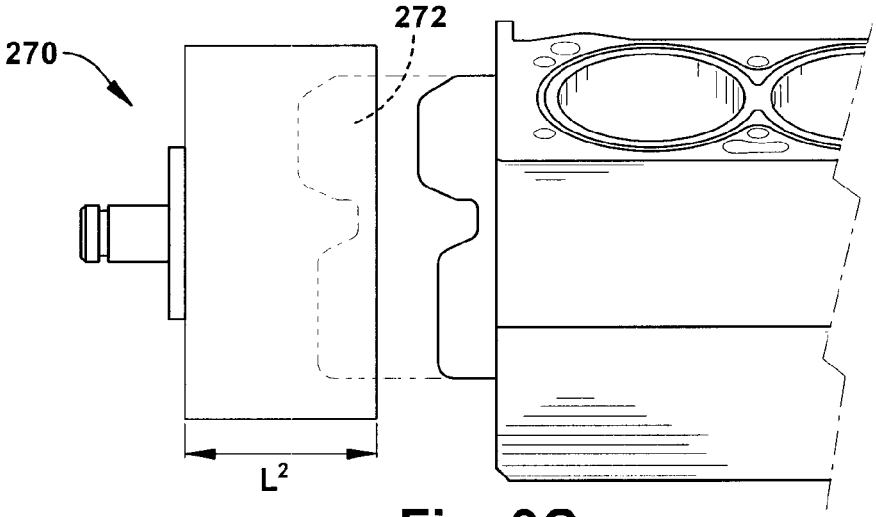
FIG. 9C is a side view illustrating a second rib pattern formed in a second end effector for securing a second engine block according to the present invention.

The alternative end effector 270 for the second engine block has a second rib pattern 272 defined therein, as shown in FIGS. 9C and 9D. The second rib pattern 272 is defined so as to be a negative of a side end surface of the second engine block that is to be received by the alternative end effector 270. The alternative end effector 270 similarly has a corresponding alternative second end effector (not shown) that has a corresponding rib pattern such that the alternative end effectors 270 cooperate to secure the second engine block by receiving side end surface of the engine block in the rib patterns 272. It is noted that the opposite side end surfaces of the engine blocks may not be identical to one another. Therefore, the rib patterns for each side end surface of the engine block may be different from one another.

Further, the alternative end effector 270 has a different width dimension L2 than the end effector 112 for the first engine block L1. By altering the width dimensions of the end effectors, articles or engine blocks having variable widths can be secured by the end effectors despite the fact that the clamp arms 104, 106 are only closable in a single closed position with a set distance therebetween.

To compensate for engine blocks having different length dimensions between side end surface to be secured using the end effectors, the end effectors are provided with variable thicknesses L1, L2 that satisfy the below equation:

$L1$ (first effector)+Width (first engine block)+$L1$ (second effector)=$L2$ (first alt. effector)+Width (second engine block)+$L2$ (second alt. effector)=Distance between first and second clamp arms when in the closed position Thus, the holding assembly 100 of the present invention is able to carrying engine blocks or articles that have both different shapes (especially of side end surfaces) and different sizes by configuring the end effectors to accommodate such changes by altering the rib patterns and the end effector thickness. Further, depending on the number of different engine blocks (or other articles) that need to be secured by the holding assembly 100, a matching number of corresponding pairs of end effectors is provided.

Figure 10:
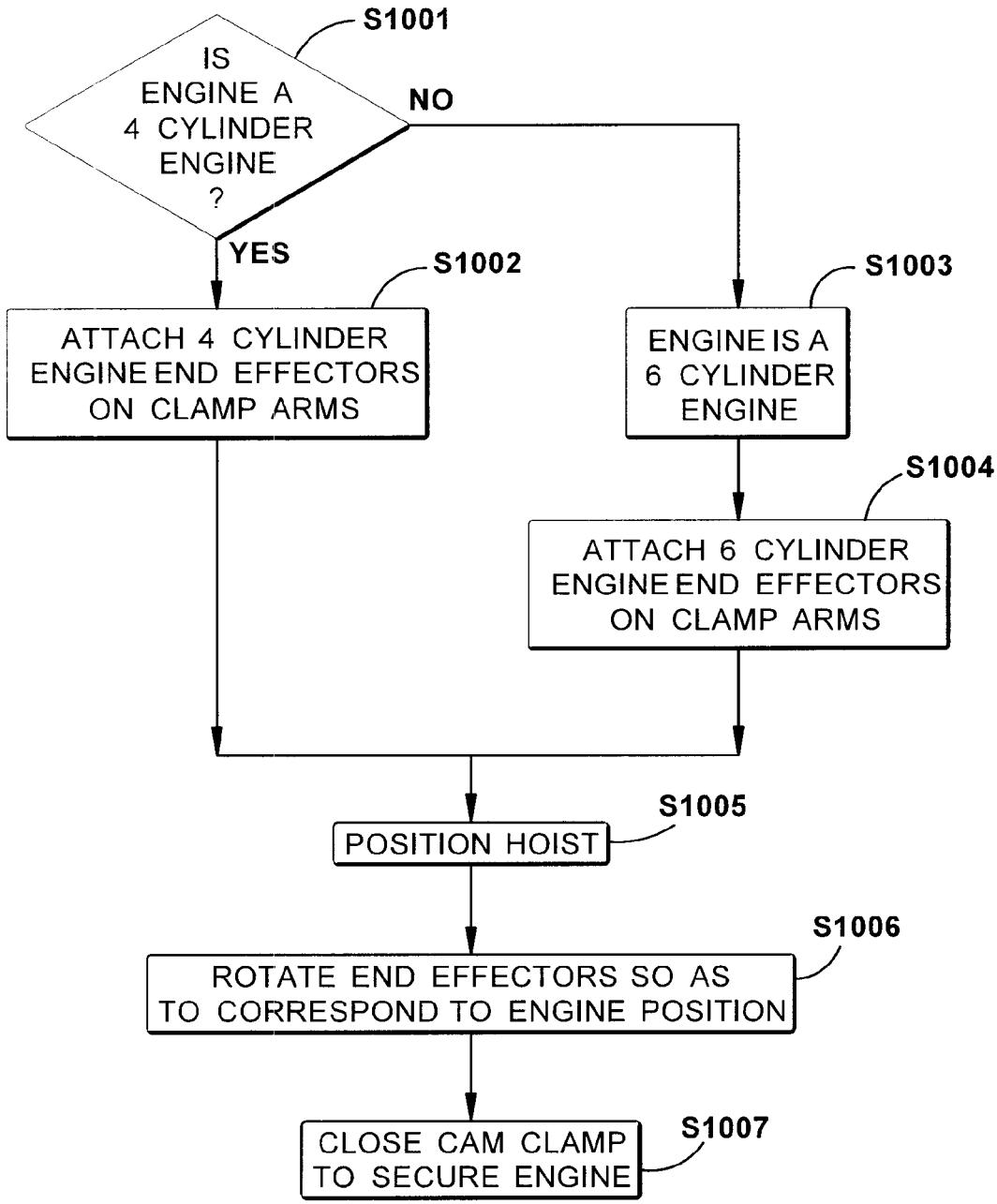
FIG. 10 is a flow chart showing a method for using the holding assembly wherein the hoisted article is either a 4-cylinder engine or a 6-cylinder engine.

With reference to FIG. 10, a flow chart illustrating a method of using the holding assembly 100 in an operation where an operator needs to lift one of either a 4-cylinder engine block or a 6-cylinder engine block is provided. Initially, the operator must determine if the engine block to be lifted is a 4-cylinder engine block or a 6-cylinder engine block (S1101).

If a 4-cylinder engine block is to be lifted (S1101, YES), then the operator attaches first and second 4-cylinder end effectors to the first and second clamp arms, respectively (S1102). If 6-cylinder end effectors are already attached to the first and second clamp arms, then the operator must first pull the 6-cylinder end effectors so as to overcome the engagement between the tubular ball detents 152 and the rod groove 266, thereby removing the 6-cylinder end effectors from the clamp arms.

If a 6-cylinder engine block is to be hoisted (S1101, NO, S1103), then the operator attaches first and second 6-cylinder end effectors to the first and second clamp arms (S1104). As with the attachment of the 4-cylinder end effectors, if the clamp arms already have the 4-cylinder end effectors secured thereto, the operator must pull the 4-cylinder end effectors out of the clamp arm bushings.

Figure 3A:
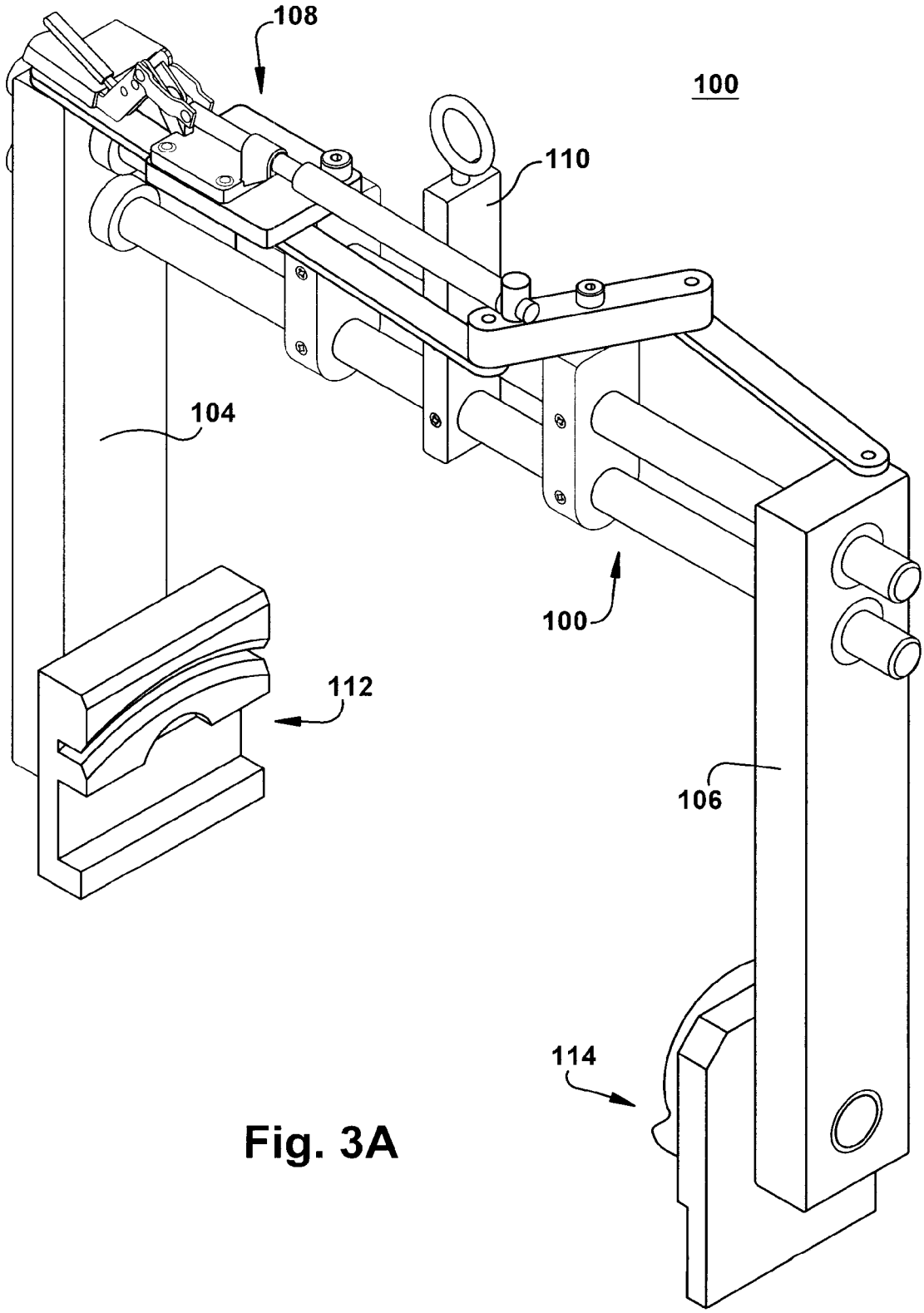
FIG. 3A is a perspective view of the holding assembly according to the present invention in the opened position.
Figure 3B:
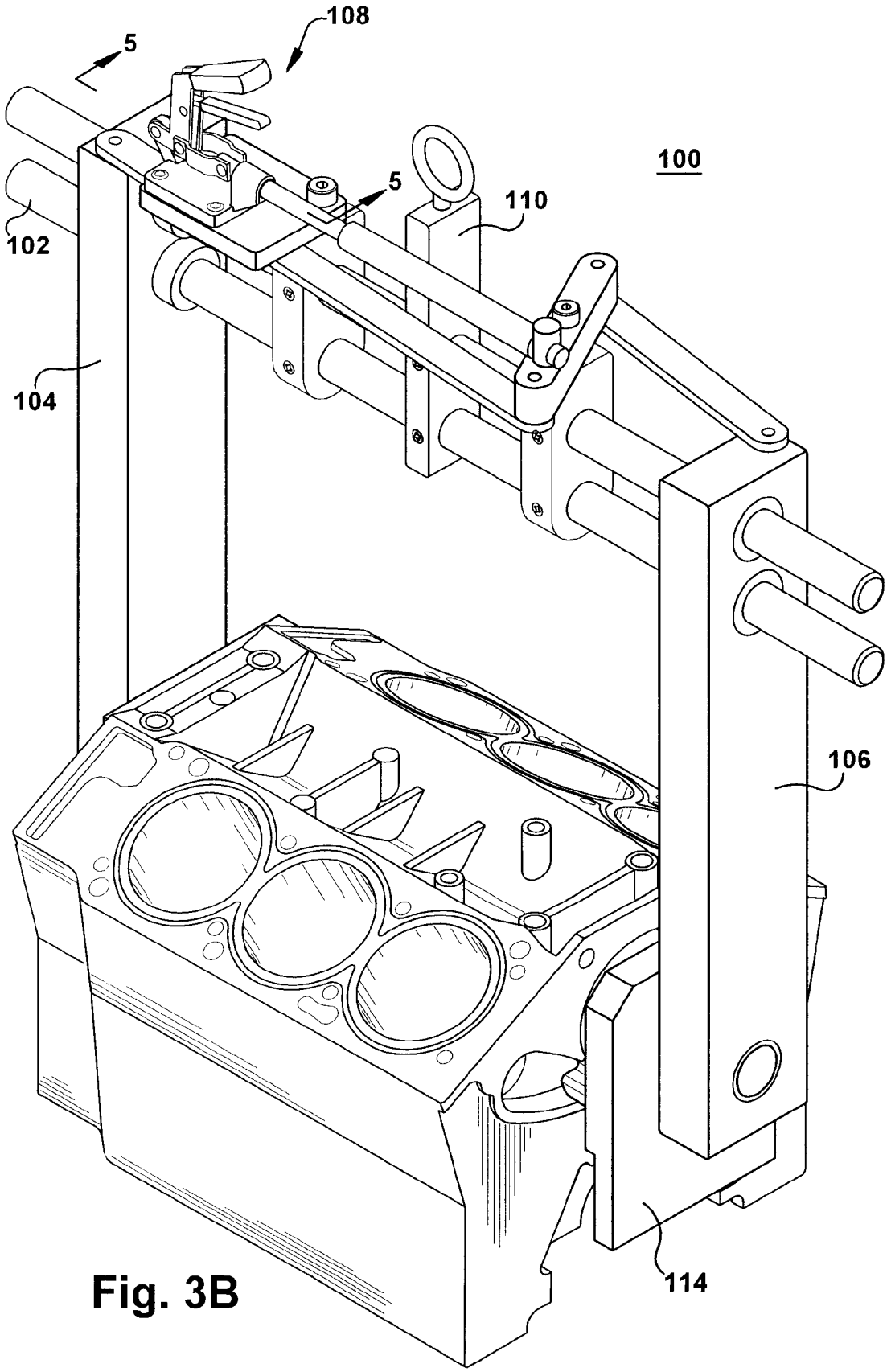
FIG. 3B is a perspective view of the holding assembly according to the present invention in the closed position.
Figure 3C:
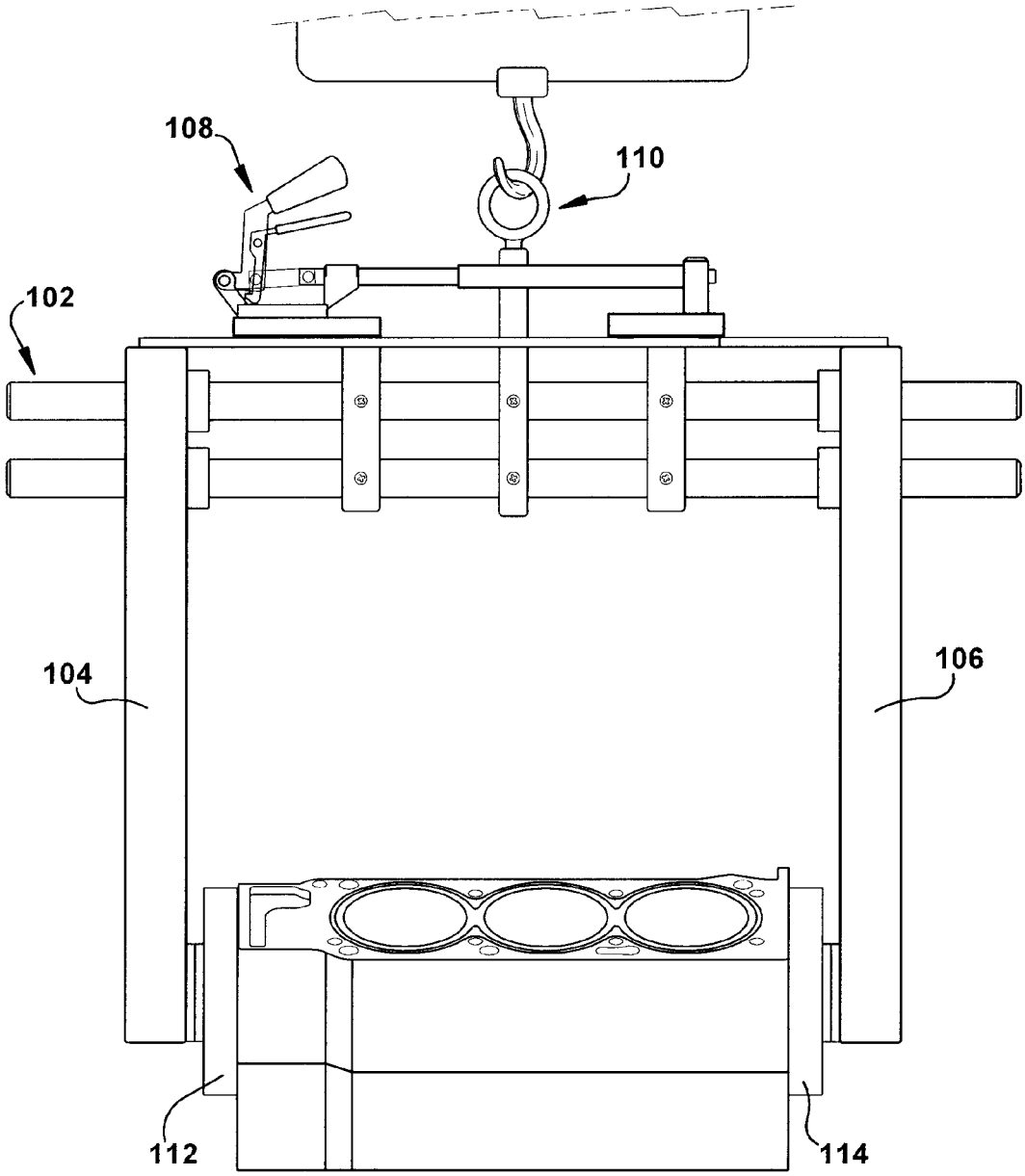
FIG. 3C is a front view of the holding assembly according to the present invention in the closed position while being supported by a carrying assembly.
Figure 4:
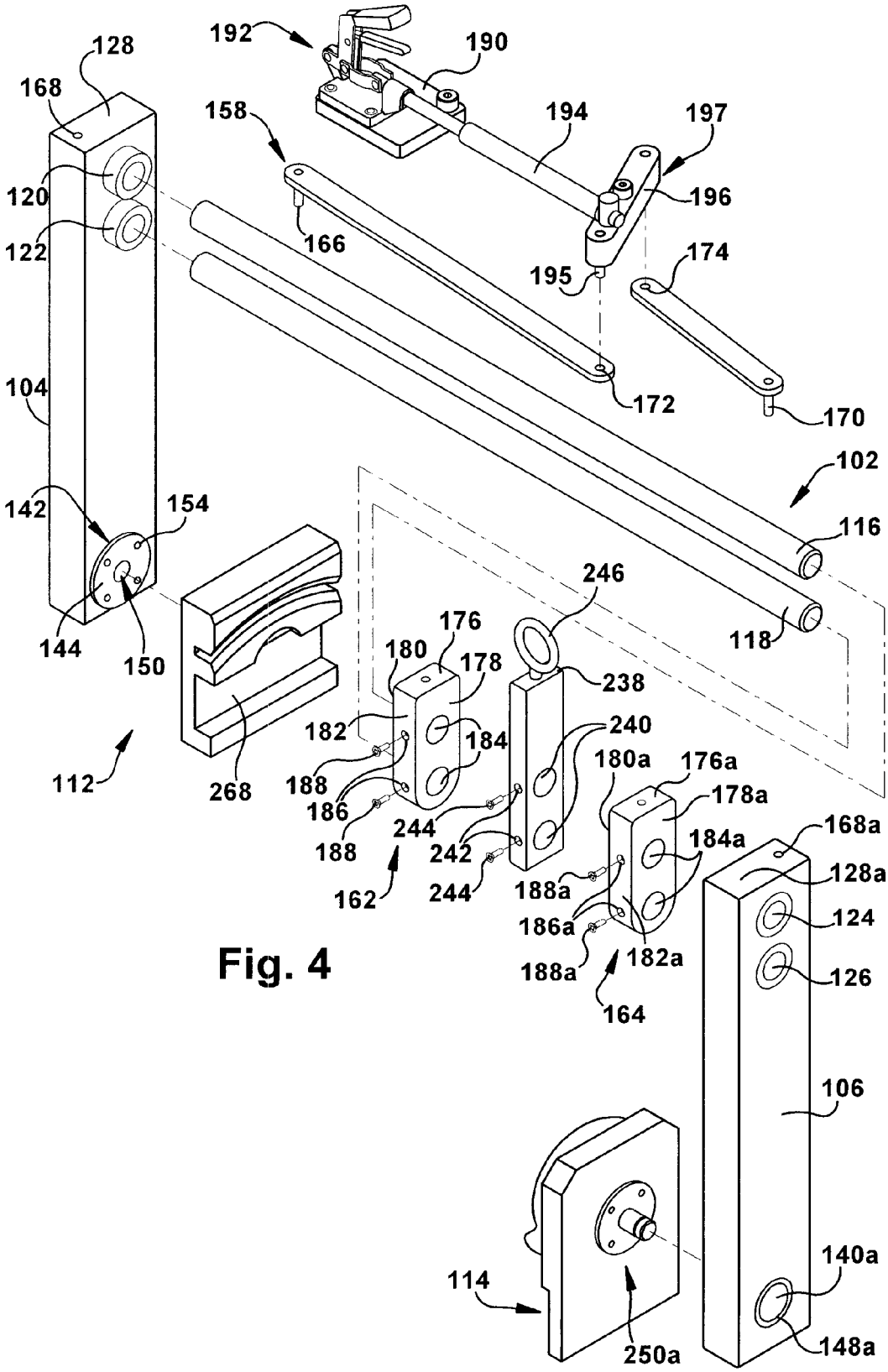
FIG. 4 is an exploded view of the holding assembly according to the present invention.
Figure 5:
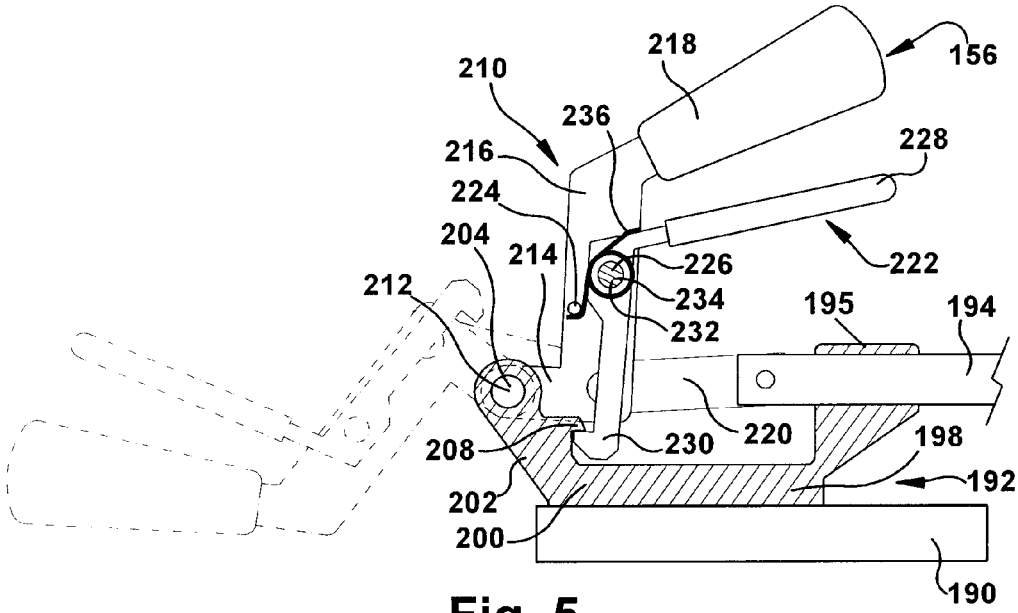
FIG. 5 illustrates a cam-clamp assembly used with the holding assembly according to the present invention.

Once the proper end effectors are attached to the clamp arms 104, 106 to secure the engine block model that the operator wishes to lift, the holding assembly 100 is positioned relative to the engine block to be hoisted (S1105), as shown in FIG. 3A. Particularly, the holding assembly 100 is positioned such that the clamp arms 104, 106 are disposed so as to be outside of and in line with the engine block side end surface that are secured by the end effectors. In other words, if the first 4-cylinder end effector is configured to receive and secure a first side end of a 4-cylinder engine block and the second 4-cylinder end effector is configured to receive and secure a second side end of the 4-cylinder engine block, the first clamp arm 104 should be positioned so as to be in line with the first side end of the 4-cylinder engine block and the second clamp arm should be positioned so as to be in line with the second side end of the 4-cylinder engine block.

At this point, the operator must then rotate the end effectors associated with the respective side end surfaces of the selected engine block such that the end effector rib patterns align with the contours of the side end surface of the engine block (S1106) to permit mating engagement between the end effectors and the engine block. In this regard, especially in certain applications, the engine blocks may not be sitting upright at all times. Thus, the end effectors can be rotated so as to receive and secure the engine block regardless of whether the engine block is sitting upright.

Once the clamp arms 104, 106 and end effectors 112, 114 are properly positioned and oriented, the clamp assembly 108 is moved from the opened position to the closed position (S1107), as shown in FIG. 3B, and the clamp arms 104, 106 are brought together and locked into place with the side end surfaces of the engine block clampingly received between the end effectors.

Once the engine block is secured by the holding assembly 100 through the end effectors 112, 114, the holding assembly 100 is lifted by the hanging assembly 110 and moved, along with the hoisted engine block, to a work station, for instance, as shown in FIG. 3C. Once at the work station, the operator can work or repair the engine block.

The rotatable end effectors 112, 114 allow the operator to rotate the engine block while the engine block is hoisted. Accordingly, rather than the operator having to either rotate the engine block before hoisting or having to work at an inconvenient angle because of the location of the portion of the engine block to be worked, the operator can rotate the engine block to reveal the portion of the engine block to be worked.

To facilitate the operator in rotating the engine block, particularly in securing the engine block in a desired rotational position, the ball detents 152 protruding from the effector bushing disc 142 cooperate with the effector disc indents 264. The ball detents 152 and indents 264 are referred to as rotation stoppers or rotation controllers.

When the end effectors 112, 114 are rotated to any of four positions, all four of the effector disc indents 264 align with and receive the effector bushing disc ball detents 152. Accordingly, when the end effectors 112, 114 are rotated to any of the four positions, the end effectors 112, 114 are releasably held in that position. The engagement between the ball detents 152 and the indents 264 should be sufficient to hold the end effectors 112, 114 in the rotational position, with the engine block hoisted, absent any additional external force. The ball detents 152 and the indents 264 disengage from one another when an external rotational force, especially in the form of an operator rotating the engine block, is applied to the engine block.

Accordingly, the operator can rotate the engine block to any of four set stopping points where the engine block will be held in place in the set rotational position. Preferably, the ball detents 152 and the indents 264 are positioned relative to the end effectors 112, 114 and the respective rib patterns 268, 268*a* such that the four rotational positions correspond to the engine block being situated upright (0°), turned to one side) (90°, upside-down (180°), and turned to another side (270°.

It is noted that the use of four corresponding ball detents 152 and indents 264 in the exemplary embodiment is provided to illustrate a set number of rotational stop positions. However, the description of four corresponding ball detents 152 and indents 264 does not limit the number of locked rotational positions the end effectors 112, 114 can be set to have.

The present invention, as described in reference to the exemplary embodiment illustrated in FIGS. 1-10, is amenable to various modifications. While all possible modifications are not all discussed herein, a few illustrative examples are provided.

One such modification amenable to the exemplary embodiment is directed to an alternative clamp assembly 508 that can readily be used with the holding assembly. The alternative clamp assembly 508 is illustrated in FIG. 11, in conjunction with a holding assembly 500 that is identical to the exemplary holding assembly 100, but for the use of the alternative clamp assembly 508.

Rather than using a hand-operated cam clamp assembly 108, the alternative clamp assembly 508 is a hydraulic or pneumatic clamp, hereinafter referred to as an automatic clamp. The automatic clamp 508 includes a drive unit 510, a first piston arm 512 slidably received in the drive unit 510 and connected at a distal end to the first clamp arm 104, and a second piston arm 514 slidably received in the drive unit 510 and connected at a distal end to the second clamp arm 106. Additionally, an actuating mechanism (not shown), herein taking the form of at least one button, is preferably disposed remotely from the clamp assembly 508.

With the automatic clamp 508, once the holding assembly 500 is positioned relative to the engine block and the end effectors 112, 114 are rotated to the proper rotational orientation, the operator presses the actuating mechanism. In response thereto, the drive unit 510 pulls the first piston arm 512 toward the second clamp arm 106, thereby pulling the first clamp arm 104 toward the second clamp arm 106, and pulls the second piston arm 514 toward the first clamp arm 104, thereby pulling the second clamp arm 106 toward the first clamp arm 104. Accordingly, the holding assembly 500 illustrated in FIG. 11 is put in a state corresponding to the closed position of the exemplary embodiment holding assembly 100, wherein the engine block is secured within the end effectors 112, 114 of the holding assembly 500. Similarly, the holding assembly 500 can be opened by pressing the same actuating mechanism button, or alternatively, providing separate opening and closing actuating mechanism buttons for operating the automatic clamp 508.

Figure 11:
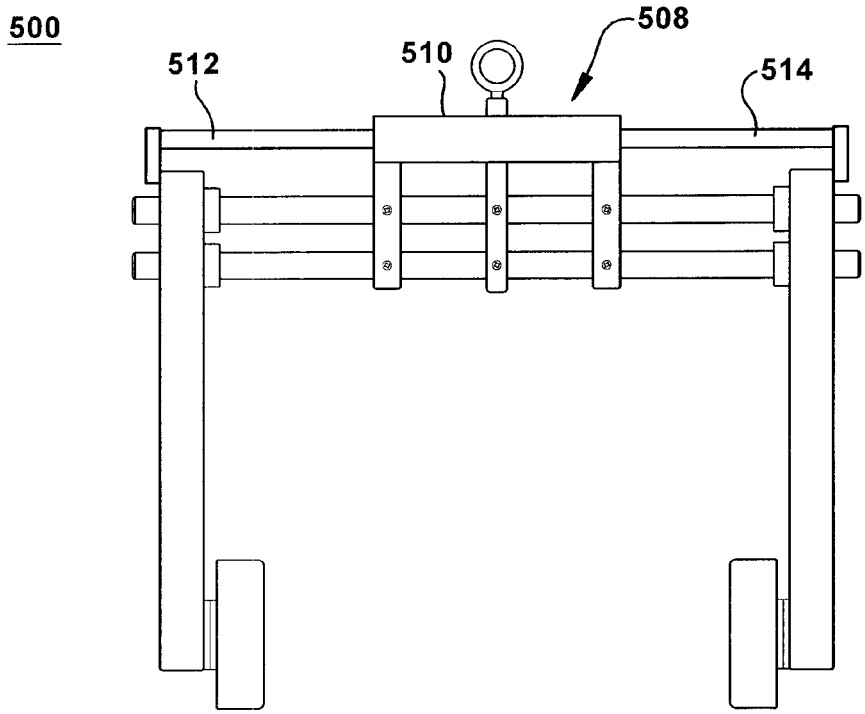
FIG. 11 is a front view of the holding assembly according to the present invention using an alternative clamp assembly.

The automatic clamp holding assembly 500 illustrated in FIG. 11 can be configured so as to provide an added benefit over the above holding assembly 100. Specifically, the above holding assembly 100 could only be set to a single closed position wherein the clamp arms 104, 106 were a set distance from each other. Accordingly, the end effectors 112, 114 for different articles compensated for the spacing differences by adjusting the effector widths. However, the automatic clamp holding assembly 500 can be configured so as to allow the clamp arms 104, 106 to close with variable distances therebetween.

One such configuration involves providing an opening actuating mechanism button and a closing actuating mechanism button, wherein the drive unit 510 opens the clamp arms 104, 106 while the opening actuating mechanism button is pressed, closes the clamp arms 104, 106 while the closing actuating mechanism button is pressed, and does not move the clamp arms 104, 106 while neither button is pressed. Thus, the operator is free to close the clamp arms 104, 106 until the engine block or article is secured therebetween. By configuring the clamp arms 104, 106 to be locked into the lateral position placed in by the automatic clamp assembly 508, the clamp arms 104, 106 can secure an article having any width within the range of motion of the clamp arms 104, 106. As such, the clamp arms 104, 106 are no longer limited to one set closed position.

Alternatively, the clamp assembly 508 can be configured to detect a resistance while closing the clamp arms 104, 106. Accordingly, once the clamp arms 104, 106 contact and begin pressing the engine block or article to be hoisted, the drive unit 510 detects the resistance acting on the closing clamp arms 104, 106, and locks the clamp arms 104, 106 into the position at the time of resistance. Accordingly, the variable closing position can be automatically set by the alternative clamp assembly 508, without requiring the operator to hold an actuating mechanism button.

Another modification that can be made to the exemplary embodiment is directed to the manner in which an engine block, or any article to be hoisted, is secured by the end effectors. Two alternative securing mechanisms are shown in the end effectors illustrated in FIGS. 12A and 12B.

Figure 12A:
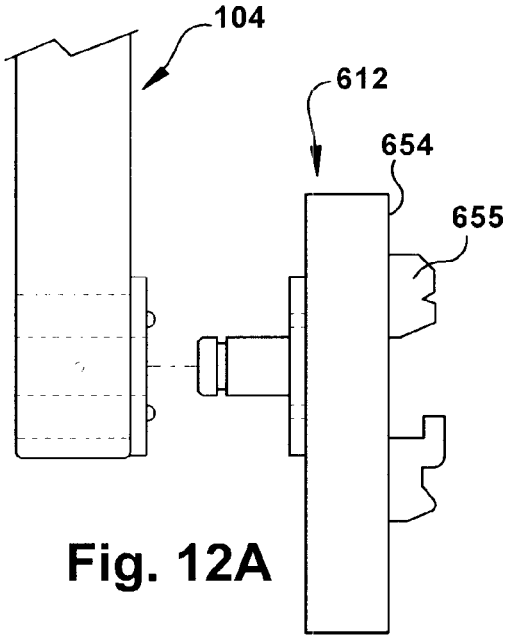
FIG. 12A is a side view of a first alternative end effector according to the present invention using a first alternative securing mechanism.

A first alternative end effector 612 shown in FIG. 12A includes an inner wall 654 that includes projecting segments 655 that project from the inner wall 654 toward the opposing end effector. The projecting segments 655 are configured so as to fit within and engage openings defined in the engine block or article. Accordingly, rather than the engine block or article fitting in and being secured by a rib pattern defined in an inner wall of the end effector, the end effector projects into and thereby secures the engine block or article.

Figure 12B:
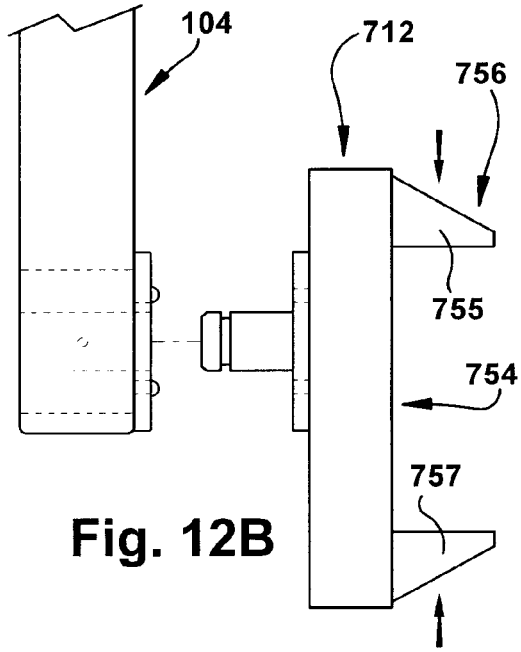
FIG. 12B is a side view of a second alternative end effector according to the present invention using a second alternative securing mechanism.

A second alternative end effector 712 shown in FIG. 12B includes an inner wall 754 that provides a vice mechanism 755 for securing the engine block or article. The vice mechanism 755 includes at least a top member 756 and a bottom member 757 that are movable toward and away from one another from a top and bottom of the end effector 712. Additionally, a pair of side members can be provided so as to provide a four point vice grip of the engine block or article.

The vice mechanism top and bottom members 756, 757, as well as the side members, can be actuated to simultaneously move toward and away from one another via a mechanical crank, a hydraulic or pneumatic drive cylinder, or automatic sensing means that sense the engine block or article between the members 756, 757 and closes the members.

Figure 13:
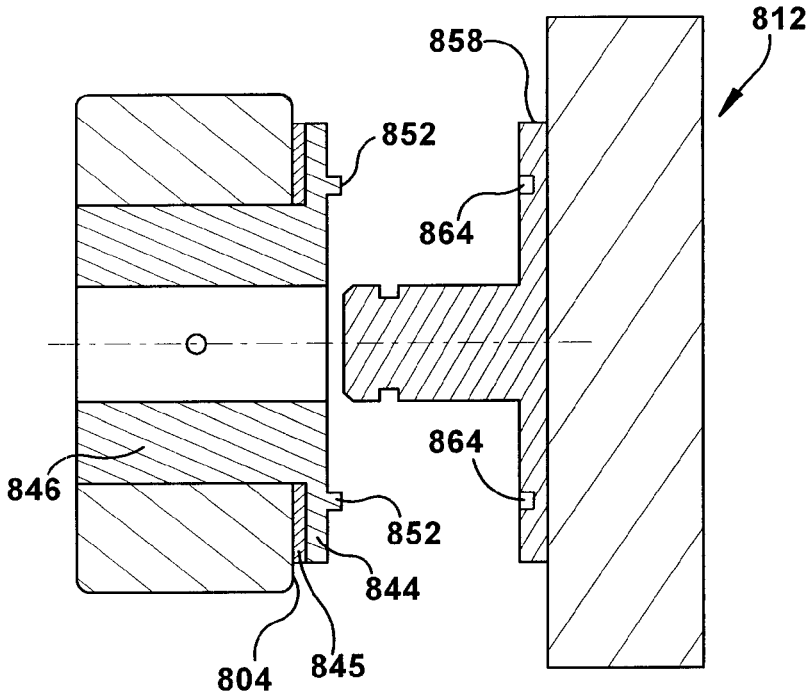
FIG. 13 illustrates the rotatable engagement of an end effector to a clamp arm having a first alternative rotation mechanism according.

A further modification can be made by varying the mechanism for end effector rotation on the clamp arm bushing. One such modification is shown in FIG. 13 wherein, an effector bushing disc 844 is rotatable relative to the clamp arm 804. The rotation of the effector bushing disc 844 its accomplished by interposing a bearing plate 845 between the clamp arm 804 and the effector bushing disc 844. Further, the effector bushing disc 844 provides fixed rectangular projections 852 protruding from the face of the effector bushing disc 844. The end effector disc 858 provides corresponding rectangular shaped indents 864 for receiving the rectangular projections 852.

The rectangular projections 852 are fixed; thus the end effector 812 is mounted to the clamp arm 804 so as to be stationary relative to the effector bushing disc 844, whereas the end effector 812 and the effector bushing disc 844 are rotatable relative to the clamp arm 804 and an effector bushing tubular portion 846.

Additionally, the rotation mechanism shown in FIG. 13 includes rotational stoppers (not shown), in the form of ball detents and corresponding indents, between the bearing plate 845 and the effector bushing disc 844. Accordingly, the end effectors 812, 814 can be rotated between set stop points where the rotation of the end effectors 804, 806 and the engine block or article are held.

Figure 14:
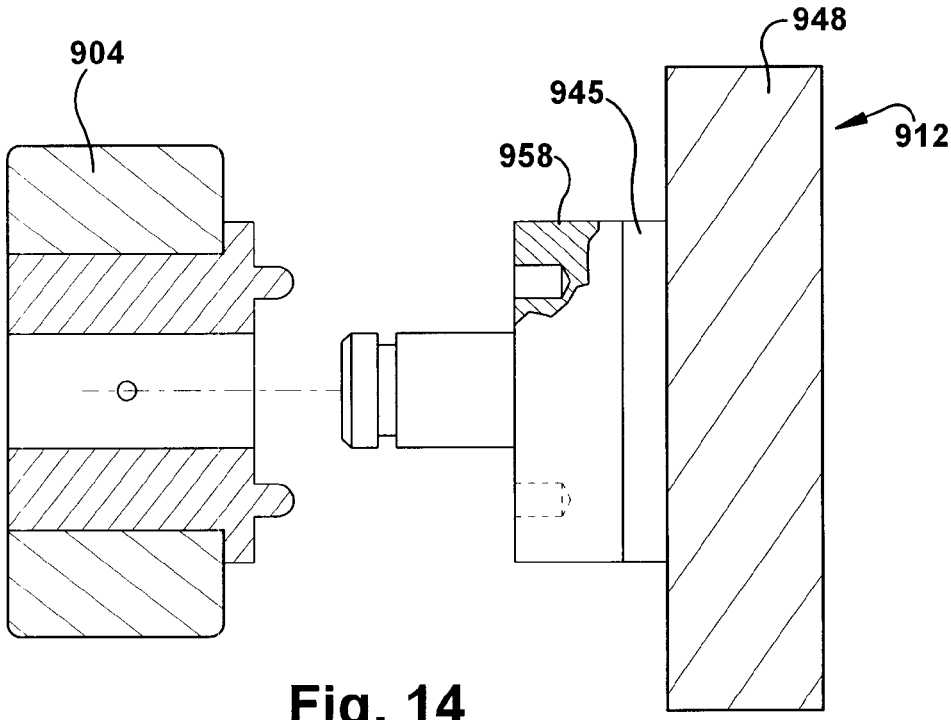
FIG. 14 illustrates the rotatable engagement of an end effector to a clamp arm having a second alternative rotation mechanism according.

A second modification to the end effector rotation mechanism is shown in FIG. 14, wherein a bearing plate 945 is provided between an effector disc 958 and an effector main body 948, so as to be rigidly secured to the effector main body 948. Accordingly, rotation of an end effector 912 takes place between the end effector main body 948 and the effector disc 958. The remainder of the assembly is rotationally stationary relative to the other components. As with the above described embodiments, a plurality of ball detents and indents are provided between the effector disc 958 and the bearing plate 945 so as to provide for a plurality of rotational stop positions.

The above modifications to the principal exemplary embodiment are provided only as illustrative examples of modifications to the exemplary embodiment. The scope of the invention is considered to include the specifically described modifications, as well as other modifications that a person of ordinary skill in the art would recognize as being within the scope of the invention.

Particularly, any modifications to the type of holding assembly, the clamp assembly, the rotation mechanism, the rotation stopping mechanism, or a method of operation of such a holding assembly is considered to be within the scope of the present invention.

What is claimed is:

1. An end effector for securing an article in a clamping holding assembly, wherein the article is secured by the end effector by having a portion of the article received in the end effector, comprising:

a main body having an inner wall and an outer wall; and a connection portion secured to the outer wall adapted to removably secure the main body to the clamping holding assembly, wherein a rib pattern is defined in the main body inner wall, the rib pattern defining an indent in the main body inner wall, the indent shaped as a negative of the portion of the article that is received in the end effector such that the end effector is configured to receive said portion of the article in the indent, wherein the connection portion rotatably secures the main body to the clamping holding assembly such that the end effector is rotatable relative to the clamping holding assembly, wherein the connection portion includes a plurality of indents defined in a face of the connection portion that faces the clamping holding assembly, wherein each of the plurality of indents are adapted to receive any one of a plurality of ball detents protruding from the clamping holding assembly, and wherein the plurality of indents and ball detents provide rotation stop points for the end effector rotation relative to the clamping holding assembly.

2. An end effector for securing an article in a clamping holding assembly, wherein the article is secured by the end effector by having a portion of the article received in the end effector, comprising:

a main body having an inner wall and an outer wall; and a connection portion secured to the outer wall adapted to removably secure the main body to the clamping holding assembly, wherein a rib pattern is defined in the main body inner wall, the rib pattern defining an indent in the main body inner wall, the indent shaped as a negative of the portion of the article that is received in the end effector such that the end effector is configured to receive said portion of the article in the indent, further comprising:

a bearing plate rigidly secured to the main body and disposed between the connection portion and the main body, wherein the bearing plate is rotatably secured to the connection portion, and a plurality of rotation stop points wherein the continued rotation of the end effector main body relative to the connection portion is impeded, the plurality of rotation stop points including:

a plurality of indents provided in a face of the bearing plate that is rotatably secured to the connection portion; and a plurality of ball detents projecting from the connection portion, wherein the plurality of ball detents are positioned such that all of the ball detents are received in the indents simultaneously.

3. An article securing member for use in a clamping holding assembly, comprising:

a first end effector adapted to be secured to a first portion of the clamping holding assembly and to secure a first portion of the an article; and a second end effector adapted to be secured to a second portion of the clamping holding assembly and to secure a second portion of the article, wherein the first end effector and the second end effector each have a main body and a connection portion, wherein the main body has an inner wall and an outer wall and the connection portion is secured to the outer wall and is adapted to removably secure the main body to the clamping holding assembly, wherein a first rib pattern is defined in the first end effector main body inner wall, the first rib pattern defining a first indent in the first end effector main body inner wall, the first indent shaped as a negative of the first portion of the article such that the first end effector is configured to receive said first portion of the article in the first indent, and wherein a second rib pattern is defined in the second end effector main body inner wall, the second rib pattern defining a second indent in the second end effector main body inner wall, the second indent shaped as a negative of the second portion of the article such that the second end effector is configured to receive said second portion of the article in the second indent, wherein the connection portions rotatable secure the first end effector main body to the first portion of the clamping holding assembly and rotatable secure the second end effector main body to the second portion of the clamping holding assembly such that the first and second end effectors are adapted to be rotatable relative to the clamping holding assembly, wherein the connection portions include a plurality of indents defined in a face of the connection portion that faces the respective portion of the clamping holding assembly, wherein each of the plurality of indents are adapted to receive any one of a plurality of ball detents protruding from the respective portion of the clamping holding assembly, wherein the plurality of indents and ball detents provide rotation stop points for the end effector rotation relative to the clamping holding assembly.

4. An article securing member for use in a clamping holding assembly, comprising:

a first end effector adapted to be secured to a first portion of the clamping holding assembly and to secure a first portion of the an article;

a second end effector adapted to be secured to a second portion of the clamping holding assembly and to secure a second portion of the article;

a first bearing plate rigidly secured to the first end effector main body and disposed between the connection portion and the main body, wherein the first bearing plate is rotatably secured to the connection portion;

a second bearing plate rigidly secured to the second end effector main body and disposed between the connection portion and the main body, wherein the second bearing plate is rotatably secured to the connection portion; and a plurality of rotation stop points wherein the continued rotation of the end effector main body relative to the respective connection portion is impeded, the plurality of rotation stop points including:

a plurality of indents provided in a face of the bearing plate that is rotatably secured to the connection portion; and a plurality of ball detents projecting from the connection portion, wherein the plurality of ball detents are positioned such that each of the plurality of ball detents is received in one of the plurality of indents simultaneously, and wherein the rotation stop points associated with the first end effector are positioned identically to the rotation stop points associated with the second end effector, wherein the first end effector and the second end effector each have a main body and a connection portion, wherein the main body has an inner wall and an outer wall and the connection portion is secured to the outer wall and is adapted to removably secure the main body to the clamping holding assembly, wherein a first rib pattern is defined in the first end effector main body inner wall, the first rib pattern defining a first indent in the first end effector main body inner wall, the first indent shaped as a negative of the first portion of the article such that the first end effector is configured to receive said first portion of the article in the first indent, and wherein a second rib pattern is defined in the second end effector main body inner wall, the second rib pattern defining a second indent in the second end effector main body inner wall, the second indent shaped as a negative of the second portion of of the article such that the second end effector is configured to receive said second portion of the article in the second indent.

* * * * *